US006485318B1

(12) United States Patent
Schoepf

(10) Patent No.: US 6,485,318 B1
(45) Date of Patent: Nov. 26, 2002

(54) ELECTRICAL SHUTTLE CONNECTOR

(75) Inventor: Thomas J. Schoepf, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/010,492

(22) Filed: Nov. 13, 2001

(51) Int. Cl.[7] ..... H01R 13/53
(52) U.S. Cl. ..... 439/187; 439/263
(58) Field of Search ..... 439/181, 187, 439/188, 263; 200/51.1

(56) References Cited

U.S. PATENT DOCUMENTS

| | | | | | |
|---|---|---|---|---|---|
| 3,474,386 | A | | 10/1969 | Link | |
| 4,632,481 | A | | 12/1986 | Le Magourou | |
| 5,213,517 | A | | 5/1993 | Kerek et al. | |
| 5,222,899 | A | | 6/1993 | Hulderman | |
| 5,393,240 | A | * | 2/1995 | Makai et al. | 439/187 |
| 5,993,230 | A | * | 11/1999 | Gauker et al. | 439/188 |
| 6,079,994 | A | * | 6/2000 | Phillips | 439/188 |
| 6,139,344 | A | * | 10/2000 | Wang | 439/188 |
| 6,168,447 | B1 | * | 1/2001 | Stepniak et al. | 439/187 |
| 6,171,129 | B1 | * | 1/2001 | Phillips | 439/346 |
| 6,416,338 | B1 | * | 7/2002 | Berlovan | 439/187 |

* cited by examiner

*Primary Examiner*—Khiem Nguyen
*Assistant Examiner*—Thanh-Tam Le
(74) *Attorney, Agent, or Firm*—Thomas N. Twomey

(57) ABSTRACT

An electrical shuttle connector is capable of being used in high electrical power applications without incurring contact erosion upon the primary electrical contact location with a male pin. A shuttle which receives the male pin is contained by and slides axially within a receptacle of the connector between a mated position and a disengaged position and through an unmated position. An arcing contact face of the receptacle and a leading arcing contact surface of the shuttle incurs any high voltage electrical arcing when mating or un-mating the electrical shuttle connector. As such, when un-mating, the arcing contact face and the leading arcing contact surface disconnect prior to the electrical disconnection of the shuttle from the male pin. When mating the connector, the shuttle establishes electrical continuity with the male pin prior to the electrical engagement of the arcing contact face with the leading arcing contact surface. The male pin is completely free from the receptacle when the shuttle is in the disengaged position, however, the shuttle remains secured within the receptacle.

13 Claims, 2 Drawing Sheets

ELECTRICAL SHUTTLE CONNECTOR

TECHNICAL FIELD OF THE INVENTION

This invention relates to an electrical connector and more particularly, to an electrical shuttle connector for high voltage applications.

BACKGROUND OF THE INVENTION

Power and signal distribution connectors mechanically and electrically connect at least two conductors at ideally the lowest possible power loss. Connectors are not designed to make and break a hot electrical circuit as are switches, relays and contactors. Nevertheless, during their service life connectors can be plugged and unplugged under load many times (i.e. hot plugged). Very often this connection under load occurs when physically switching off the power in advance would be considered time consuming and inconvenient. Also, connectors in automotive power networks are plugged and unplugged under load during diagnostic procedures, fuses are plugged at short circuit conditions, and so forth.

In the present 14 volt direct current, VDC, automotive power networks, no serious consequences are associated with plugging and unplugging under load due to very short break arcs (the system voltage is approximately the same as the minimum arc voltage of the contact material). However, the world's leading car manufactures and component suppliers are promoting 42 VDC power networks to meet the high power requirements of future vehicles. Unfortunately, even one mating or disconnect under a 42 VDC load may damage a standard connector terminal beyond repair. In other words, under specific conditions, a long arc may be generated at matings or disconnects which may cause high contact erosion. This erosion may damage the physical shape of the connector terminal preventing re-mating or hindering proper terminal contact forces after mating.

SUMMARY OF THE INVENTION

An electrical shuttle connector is capable of being used in high electrical power applications without incurring contact erosion upon the primary electrical contact location with a male pin. A shuttle which receives the male pin is contained by and slides axially within a receptacle of the connector between a mated position and a disengaged position and through an unmated position. An arcing contact face of the receptacle and a leading arcing contact surface of the shuttle incurs any high voltage electrical arcing when mating or un-mating the electrical shuttle connector. As such, when un-mating, the arcing contact face and the leading arcing contact surface disconnect prior to the electrical disconnection of the shuttle from the male pin. When mating the connector, the shuttle establishes electrical continuity with the male pin prior to the electrical engagement of the arcing contact face with the leading arcing contact surface. The male pin is completely free from the receptacle when the shuttle is in the disengaged position, however, the shuttle remains secured within the receptacle.

The shuttle slides axially and co-linearly with the male pin between the mated, un-mated and disengaged positions. A primary contact surface of the shuttle faces laterally inward and moves laterally when the shuttle moves between the un-mated and disengaged positions, thereby engaging to or disengaging from the sides of the male pin. With the primary electrical connection made, the arcing contact face of the receptacle and the leading arcing contact surface of the shuttle engages and disengages from one another when the shuttle moves between the mated and un-mated positions and the primary contact remains engaged.

An advantage of the present invention is the elimination of electrical arcing erosion of the male pin of an electrical connector. Another advantage of the present invention is the ability to connect and disconnect the electrical connector used within a hot electrical circuit, thereby saving time when performing maintenance or repairs.

BRIEF DESCRIPTION OF THE DRAWINGS

The presently preferred embodiments of the invention are disclosed in the following description and in the accompanying drawings, wherein.

DETAILED DESCRIPTION OF THE PREFERRED EMBODIMENTS

Figure 1:
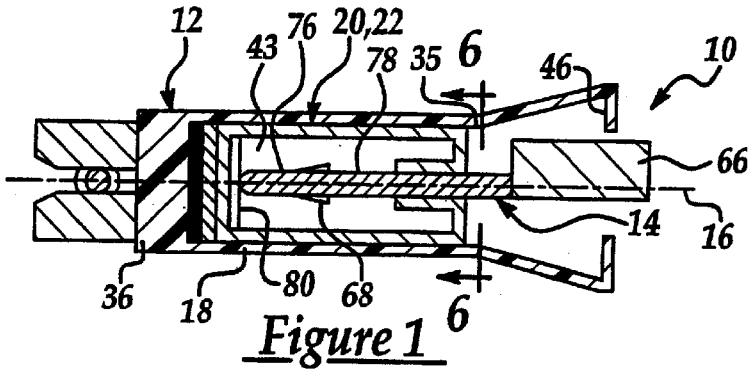
FIG. 1 is a longitudinal cross-sectional view of an electrical shuttle connector of the present invention.
Figure 2:
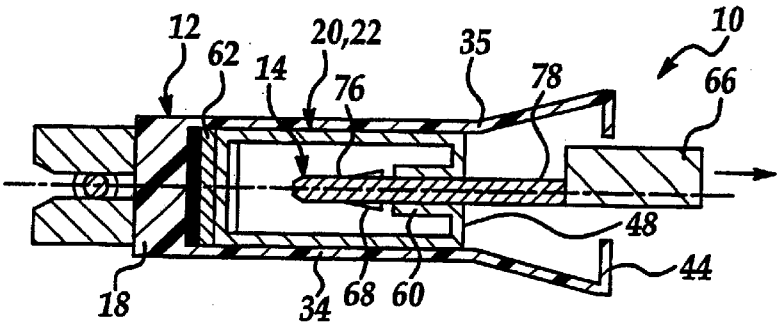
FIG. 2 is a cross-sectional view of the electrical shuttle having a male pin moving in a rearward direction as indicated by the arrow.
Figure 3:
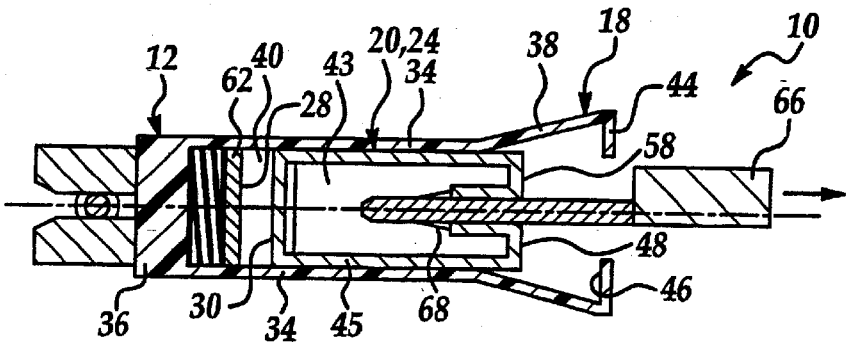
FIG. 3 is a cross-sectional view of the electrical shuttle connector moving in a rearward direction as indicated by the arrow and being in an unmated position.
Figure 4:
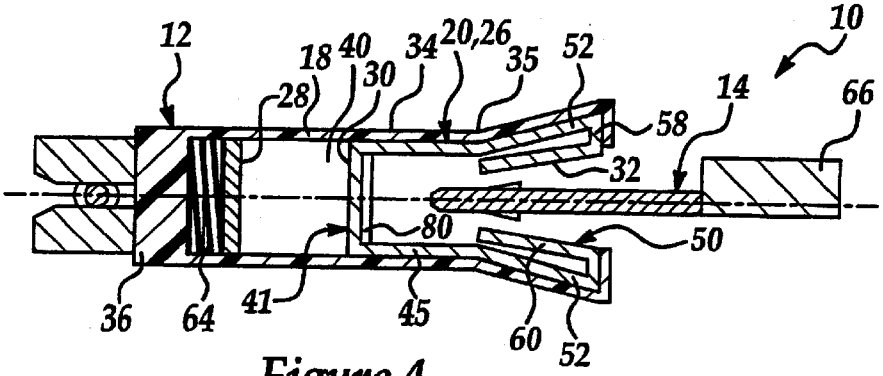
FIG. 4 is cross-sectional view of the electrical shuttle connector shown in a disengaged position.

Referring now to FIGS. 1–6, an electrical shuttle connector 10 of the present invention has a receptacle 12 which receives a planar male bar or pin 14 along a central axis 16. Electrical shuttle connector 10 is ideal for repeatable high power connections because it diverts the electrical arcs, created during the un-mating process and common in high power circuits, from the male pin 14 thereby protecting the male pin 14 from arc induced corrosion. The electrical arc is diverted to a shuttle 20 carried slideably in an axial direction and resiliently in a lateral direction by an insulator housing 18 of the receptacle 12. Shuttle 20 moves along the central axis 16 from a mated position 22, as best shown in FIG. 1, to an intermediate or unmated position 24, as best shown in FIG. 3, and into a disengaged position 26, as best shown in FIG. 4. Mating of connector 10 or movement of the shuttle 20 from the disengaged position 26 toward the mated position 22 is caused by the insertion of the male pin 14, and movement of the shuttle 20 away from the mated position 22 and toward the disengaged position 26 is caused by the withdrawal of male pin 14 from the receptacle 12.

When the shuttle 20 is in the mated position 22 (FIGS. 1 and 2), an arcing contact face 28 of the receptacle 12 is engaged electrically to a leading arcing contact surface 30 of the shuttle 20. And, two opposing primary contact surfaces 32 of the shuttle 20 (FIG. 4), which face radially inward toward one another about the central axis 16, are engaged electrically to both respective planar sides of the elongated male bar or pin 14. When the shuttle 20 is in the unmated position 24 (FIG. 3), the leading arcing contact surface 30 of shuttle 20 and the arcing contact face 28 of the receptacle 12 are disengaged or axially spaced from one another. Electrical arcing may occur between the leading arcing contact surface 30 and the arcing contact face 28 when the shuttle 20 is moved from the mated position 22 (FIGS. 1 and 2) to the unmated position 24 (FIG. 3). When in the unmated position 24, the two opposing primary contact surfaces 32 remain engaged to the male pin 14 even though the electrical circuit is now open, it is not until the electrical shuttle connector 10 is in the disengaged position 26 (FIG. 4) that the primary contact surfaces 32 of the shuttle 20 disengage from the male pin 14 so that the male pin 14 is free to move away from receptacle 12 without further interaction. Arcing between the male pin 14 and the primary contact surfaces 32 is prevented from occurring at this stage or position since the circuit is already open.

The insulator housing 18 of the receptacle 12 has a forward end portion 36 which generally traverses and is substantially centered to the central axis 16. Projecting rearward and perpendicularly from the forward end portion 36 and engaged unitarily at two opposite lateral ends of the forward end portion 36 are two respective opposing walls 34 which extend diametrically along the central axis 16. A void 40 centered along the axis 16 is defined laterally between the walls 34 and axially between the forward end portion 36 and a distal end 35 of each wall 34. The shuttle 20 is completely disposed slideably and snugly within the void 40 when in the mated position 22, and partially disposed in the void 40 when in either the unmated or disengaged positions 24, 26. A leading base 41 of the shuttle 20 remains fitted snugly within the void 40 of the housing 18 regardless of shuttle position. The base 41 carries the leading arcing contact surface 30 on the leading side and defines a blind space 43 at the trailing side. The space 43 is defined laterally by two opposing parallel walls 45 of the base 41 projecting rearward and snugly fitted against the respective walls 34 of the housing 18.

The shuttle 20 is carried at all times by the receptacle 12. Preventing complete withdrawal of the shuttle 20 from the housing 18 when the shuttle 20 is in the disengaged position 26 is a trailing stop surface 48 of the shuttle 20 which contacts a rearward stop face 46 of the housing 18. A lateral member 44 of the housing 18 carries the rearward stop face 46 and an angled member 38 engages unitarily between the lateral member 44 and a distal end 35 of each respective wall 34. The angled member 38 projects rearward and laterally outward from each distal end 35, and the lateral member 44 projects unitarily and laterally inward from the angled member 38. The distal or diametrically opposed ends of each lateral member 44 are spaced sufficiently apart from one another to permit initial assembly or insertion of the shuttle 20 into the receptacle 12.

Each trailing stop surface 48 is carried by a respective trailing portion 50 of the shuttle 20 which is cantilevered from the respective distal end of each wall 45 of the base 41. The trailing portion 50 has a cantilevered member 52 which projects rearward and laterally outward from the wall 45 and is engaged unitarily between the wall 45 and a laterally inward extending leg 58 which defines the trailing stop face 48. During manufacturing or initial assembly of the shuttle connector 10, the diametrically opposed trailing portions 50 are flexed radially or laterally inward so that the shuttle 20 can fit between the distal ends of the lateral members 44 of the housing 18 while the shuttle is inserted into the receptacle 12. Once the legs 58 of the shuttle 20 move axially forward of the lateral members 44 of the housing 18, the trailing portion 50 of the shuttle 20 will snap resiliently and laterally outward thereby orientating the shuttle 20 into the disengaged position 26.

The cantilevered member 52 of the trailing portion 50 of the shuttle 20 is orientated close to or fitted snugly against the angled member 38 of the housing 18 assuring that the shuttle 20 remains within the disengaged position 26 and will not move forward until an external axial force exerted upon the male pin 14 overcomes the resilience of the trailing portion 50 and moves the shuttle 20 forward toward the unmated position 24. The male pin 14 has a forward segment 76 engaged co-linearly to a rearward segment 78. Forward movement of shuttle 20 occurs when a distal end of the male pin 14 carried by the forward segment 76 forcibly contacts a bottom surface 80 of the base 41, or bottom of space 43. When contacted, the forward segment 76 of the male pin 14 is disposed completely within the space 43. As the shuttle 20 moves forward toward the unmated position 24, the cantilevered member 52 flexes laterally inward and a foot 60 of the cantilevered member 52 which substantially projects axially forward from the lateral member 44 and which carries the primary contact surface 32 engages the rearward segment 78 of the male pin 14 from a lateral direction. This engagement simultaneously signifies the unmated position 24 of the shuttle connector 10.

With the distal end or tip of the male pin 14 engaged upon the leading base 41 of the shuttle 20 along the central axis 16, and the primary contact surface 32 of the foot 60 of the shuttle 20 engaged to the longitudinal sides of the rearward segment 78 of the male pin 14, continued insertion of pin 14 causes the shuttle 20 to move axially forward until the leading arcing contact surface 30 of the leading base 41 electrically engages the arcing contact face 28 of the receptacle 12.

The arcing contact face 28 is defined by an arcing contact member 62 disposed within the bore 40 of the insulative housing 18. The arcing contact member 62, and likewise the leading arcing contact surface 30 have a high resistance to arc erosion and can resemble a variety of forms including rivets, contact tapes, and discs. Disposed between the arcing contact member 62 and the forward end portion 36 of the insulative housing 18 is an axially compressible spring 64. Prior to the shuttle reaching the mated position 22, the spring 64 is fully extended thereby positioning the arcing contact member 62 in a rearward position. Continued forward movement of the shuttle 20 causes the arcing contact member 62 to engage the leading base 41 of the shuttle 20. The spring 64 compresses as the arcing contact member 62 is moved axially forward along the central axis 16. The spring 64 assures a robust electrical shuttle connector 10 by providing a repeatable electrical contact connection regardless of any arcing erosion. Full insertion and therefore a mated position 22 is achieved when the insulator housing 18 snap locks to a structure 66 engaged directly to the male pin 14 via a typical mechanical snap-lock device such as a flexible lock arm projected rearward from the structure 66 and engaging the rearward stop face 46 of the housing 18 at mid-length (not shown).

Disengagement, or unmating of the electrical shuttle connector 10 is achieved by pulling the male pin 14 in a rearward direction. This causes the primary contact surface 32 of the foot 60 of the shuttle 20 to slide against, while maintaining contact or continuity with, the sides of the male pin 14. Simultaneously, the tip of the male pin 14 moves axially away from the bottom surface 80 of the leading base 41. This sliding relationship ceases when each distal end of the feet 60 engage respective diametrically opposed fins 68 of the forward segment 76 of the male pin 14. The fins 68 project laterally outward from each side of the male pin 14. Axial engagement of the fin 68 to the distal end of the foot 60 rigidly engages the shuttle 20 to the male pin 14 so that continued movement of the male pin 14 in the rearward direction causes the shuttle 20 to move with it. As shuttle 20 moves, the arcing contact surface 30 of shuttle 20 becomes disengaged from the arcing contact face 28 of the arcing contact member 62 after the spring 64 is fully extended. An arc, may then occur within the bore 40 between the arcing contact member 62 and the shuttle 20, however, because the primary contact surface 32 remains electrically engaged to the male pin 14, the male pin 14 does not undergo any arcing erosion. Any erosion which occurs will be between the leading base 41 of the shuttle 20 and the arcing contact member 62.

In order to improve erosion and welding behavior of the arcing contact, the leading base 41 and the arcing contact member 62 may carry contact pieces (e.g. rivets, or contact tapes, not shown.) The arc will then be driven directly between the contact pieces (e.g. rivets or tapes) made of contact material with high resistance to arc erosion and contact welding.

As shuttle 20 continues to move in the rearward direction, along with the male pin 14, the cantilevered member 52 begins to flex radially outward substantially against the angled members 38 of the housing 18. With this lateral outward flexing, the primary contact surface 32 moves radially outward and disengages from the male pin 14. The foot 60 simultaneously moves radially outward enough to release the fin 68 and thereby release the male pin 14. At this point, the trailing stop face 48 of the leg 58 is disposed near or engages the rearward stop face 46 of the lateral member 44 of the housing 18 and the electrical shuttle connector 10 is in the disengaged position 26.

Figure 5:
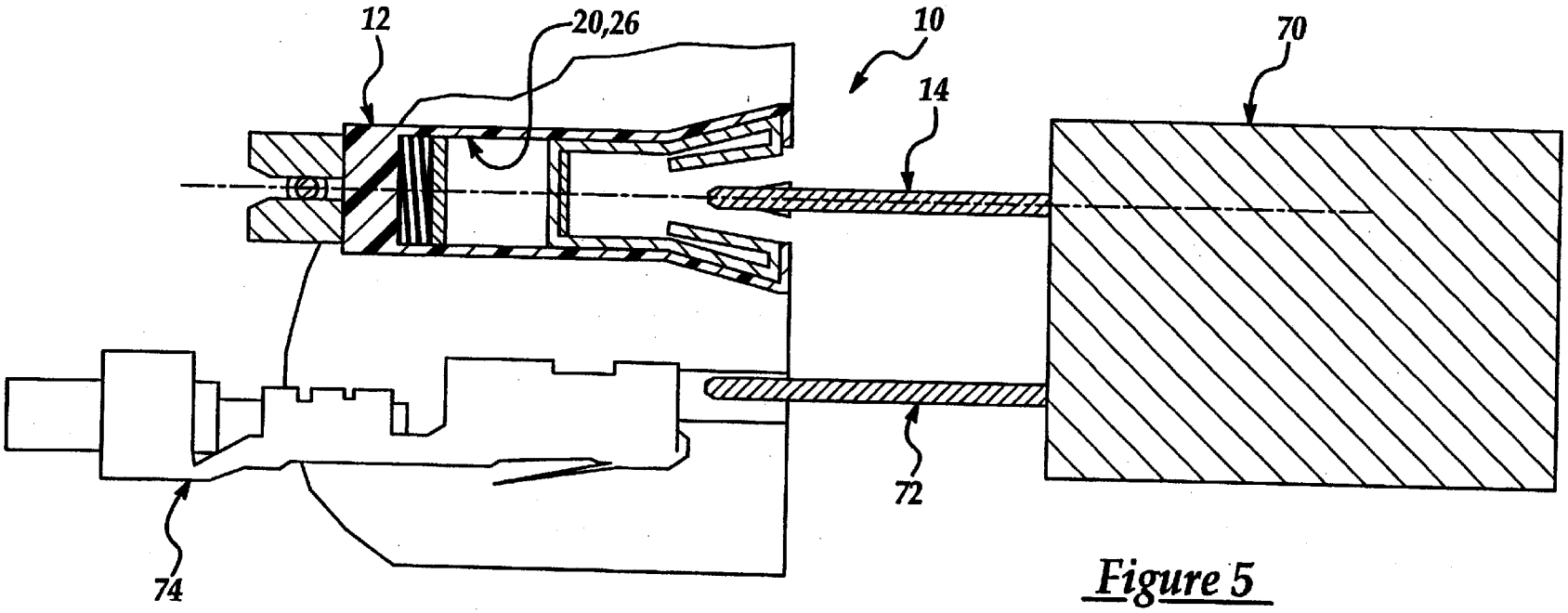
FIG. 5 is a fragmentary cross-sectional view of the electrical shuttle connector shown in a relay environment.

Referring to FIG. 5, the electrical shuttle connector 10 is shown within a relay environment. The male pin 14 is an integral part of a relay module 70 which has a second male pin 72 disposed parallel to the male pin 14. The male pin 14 is applied to the high voltage side and the secondary male pin 72 is on the low voltage side of the relay modular 70. As the male pin 14 mates within the receptacle 12 of the electrical shuttle connector 10 the secondary male pin, or low voltage pin 72 simultaneously mates within a standard receptacle 74 which does not have a shuttle.

Figure 7:
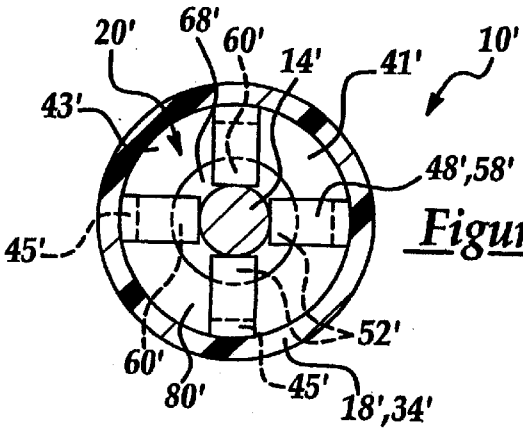
FIG. 7 is a cross-sectional view of a second embodiment of the electrical shuttle connector for round pins similar to FIG. 6.
Figure 6:
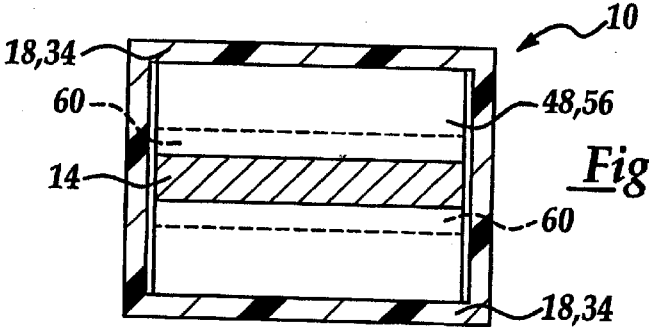
FIG. 6 is a cross-sectional view of the electrical shuttle connector for blade pins taken along line 6—6 of FIG. 1.

Referring to FIG. 7, a second embodiment of the present invention is shown. A male pin 14' is rod-shaped instead of planar as is the male pin 14 in the first embodiment. A housing 18', preferably molded as one piece from an electrically insulative material such as plastic, is substantially tubular in shape having a single circular wall 34' which defines a void or bore 40'. A shuttle 20' disposed within the housing 18' has a leading base 41' which defines a space 43' being substantially cylindrical in shape. Spaced equally and circumferentially about the space 43' is a series of walls 45', a total of four as illustrated in FIG. 7. Likewise, a series of cantilevered members 52' project rearward from the distal ends of each respective wall 45'. Encircling the male pin 14' is a fin 68' which forms a single rearward facing annular surface that engages all of the cantilevered members 52' when the shuttle 20' is moved rearward from the mated position 22 and into the disengaged position 26.

Although the preferred embodiments of the present invention have been disclosed, various changes and modifications may be made thereto by one skilled in the art without departing from the scope and spirit of the invention as set forth in the appended claims. It is also understood that the terms used herein are merely descriptive, rather than limiting, and that various changes may be made without departing from the scope and spirit of the invention.

What is claimed is:

1. An electrical connector comprising:

an elongated male pin;

a receptacle having a rearward facing arcing contact face;

a shuttle constructed and arranged to slide axially within the receptacle between a mated position and a disengaged position and through an un-mated position orientated between the mated and disengaged positions, the mated position orientated axially forward of the disengaged position;

the shuttle having a forward facing arcing contact surface and a lateral inward facing primary contact surface;

the arcing contact surface of the shuttle being engaged electrically to the arcing contact face of the receptacle and the primary contact surface of the shuttle being laterally engaged electrically to the male pin when the shuttle is in the mated position; and the arcing contact surface of the shuttle being axially spaced from the arcing contact face of the receptacle, and the primary contact surface of the shuttle being engaged to the male pin when the shuttle is in the un-mated position; and the arcing contact surface of the shuttle being axially spaced from the arcing contact face of the receptacle, and the primary contact surface of the shuttle being spaced laterally from the male pin when the shuttle is in the disengaged position.

2. The electrical connector set forth in claim 1 further comprising:

the receptacle having a forward facing stop face orientated axially rearward of the shuttle; and the shuttle having a rearward facing trailing stop surface facing the rearward stop face; the trailing stop surface being in an engageable relationship to the stop face of the receptacle thereby preventing axial withdrawal of the shuttle from the receptacle when the shuttle is in the disengaged position.

3. The electrical connector set forth in claim 2 wherein the receptacle has an elongated electrical insulator housing defining a void, the shuffle disposed with in the void and carried slideably by the housing.

4. The electrical connector set forth in claim 3 further comprising:

an arcing contact member having the arcing contact face, the arcing contact member engaged rigidly to the housing and disposed within the void of the housing; and the insulator housing having a wall extending rearward from and disposed perpendicular to the arcing contact member, the shuttle being carried slideably by the wall.

5. The electrical connector set forth in claim 4 wherein the shuttle has a base, a space and a cantilevered trailing portion, the space defined by the base, the base having the leading contact surface, the trailing portion projecting rearward and laterally outward from the base and laterally beyond the wall of the housing when the shuttle is in the disengaged position, the trailing portion being flexed resiliently laterally inward against the wall of the housing when the shuttle is in the mated or unmated positions.

6. The electrical connector set forth in claim 5 wherein the trailing portion of the shuttle has the primary contact surface.

7. The electrical connector set forth in claim 6 wherein the insulator housing of the receptacle has an angled member and a lateral member, the angled member engaged between the wall and the lateral member, the angled member projecting axially rearward and laterally outward from the wall, the lateral member projecting laterally inward from the angled member, the lateral member having the stop face.

8. The electrical connector set forth in claim 7 further comprising:

the male pin having a forward segment and a rearward segment, the forward segment disposed within the space of the shuttle when the shuttle is in the mated and unmated positions;

the forward segment having a fin extended laterally outward from the male pin;

the trailing portion of the shuttle having a forward stop surface defining the space, the fin being engaged to the forward stop surface in order to move the shuttle from the mated to the unmated position; and wherein the trailing portion laterally moves outward and clears the fin when the shuttle moves from the unmated to the disengaged position.

9. The electrical connector set forth in claim 8 further comprising a coiled spring disposed within the void and axially between the arcing contact member and the insulator housing, the spring being compressed when the shuttle is in the mated position.

10. The electrical connector set forth in claim 8 further comprising:

the male pin being an elongated planar bar wherein the fin is one of two fins each one extended laterally outward from a respective side of the planar bar;

the wall of the base being one of two opposite walls being parallel to one another and laterally defining the space, the cantilevered trailing portion being one of two cantilevered trailing portions each one projecting rearward from a respective one of the two opposite walls; and the wall of the housing being one of two walls, the walls laterally defining the void, the angled member and the lateral member both being one of two angled and lateral members wherein each one of the two walls have a respective one of the two angled and lateral members.

11. The electrical connector set forth in claim 8 further comprising:

the male pin being a rod wherein the fin extends circumferentially about the male pin;

the wall of the base being one of a plurality of circumferentially spaced walls being parallel to one another and laterally defining the space, the cantilevered trailing portion being one of a plurality of cantilevered trailing portions each one projecting rearward from a respective one of the plurality of walls; and the wall of the housing being one of a plurality of walls, the plurality of walls laterally defining the void, the angled member and the lateral member both being one of a plurality of angled and lateral members wherein each one of the plurality of walls have a respective one of the plurality of angled and lateral members.

12. An electrical connector comprising:

an elongated male pin;

a receptacle having a rearward facing arcing contact face and an opposing stop face disposed rearward of the arcing contact face;

a shuttle constructed and arranged to slide axially within the receptacle between a mated position and a disengaged position and through an unmated position orientated between the mated and disengaged positions, the mated position being orientated forward of the disengaged position;

the shuttle having a forward facing arcing contact surface, a rearward facing trailing stop surface, and a lateral inward facing primary contact surface;

the arcing contact surface of the shuttle being engaged electrically to the arcing contact face of the receptacle and the primary contact surface of the shuttle being engaged electrically to the male pin when the shuttle is in the mated position;

the arcing contact surface of the shuttle being axially spaced from the arcing contact face of the receptacle and the primary contact surface of the shuttle being engaged to the male pin when the shuttle is in the unmated position; and the arcing contact surface of the shuttle being spaced axially from the arcing contact face of the receptacle and the trailing stop surface being in an engageable relationship to the stop face of the receptacle thereby preventing axial withdrawal of the shuttle from the receptacle when the shuttle is in the disengaged position.

13. A method of disconnecting an electrical shuttle connector comprising the steps of:

sliding an elongated male pin in an axial rearward direction against a primary contact surface of a stationary shuttle orientated within a stationary receptacle in a mated position;

engaging a fin projected laterally outward from the male pin axially against the shuttle;

disengaging a rearward facing arcing contact face of the stationary receptacle from a leading arcing contact surface of the shuttle when the shuttle axially moves from the mated position to an un-mated position within the receptacle;

un-flexing laterally a cantilevered member of the shuttle;

simultaneously un-mating the primary contact surface of the shuttle from the male pin in the lateral direction when the shuttle axially moves rearward from the unmated position to a disengaged position within the receptacle; and removing the male pin from the receptacle.

* * * * *